US009121237B2

(12) United States Patent
Kumar et al.

(10) Patent No.: US 9,121,237 B2
(45) Date of Patent: Sep. 1, 2015

(54) METHODS OF COATING WELLBORE TOOLS AND COMPONENTS HAVING SUCH COATINGS

(75) Inventors: Sunil Kumar, Celle (DE); Hendrik John, Celle (DE)

(73) Assignee: BAKER HUGHES INCORPORATED, Houston, TX (US)

( * ) Notice: Subject to any disclaimer, the term of this patent is extended or adjusted under 35 U.S.C. 154(b) by 830 days.

(21) Appl. No.: 13/193,336

(22) Filed: Jul. 28, 2011

(65) Prior Publication Data

US 2013/0025941 A1 Jan. 31, 2013

(51) Int. Cl.

| | |
|---|---|
| ***E21B 7/00*** | (2006.01) |
| ***E21B 10/36*** | (2006.01) |
| ***E21B 10/46*** | (2006.01) |
| ***C23C 30/00*** | (2006.01) |
| ***E21B 49/10*** | (2006.01) |
| ***E21B 4/02*** | (2006.01) |
| ***F03C 2/08*** | (2006.01) |
| ***F04C 13/00*** | (2006.01) |
| *F04C 2/107* | (2006.01) |

(52) U.S. Cl.

CPC ..... *E21B 10/46* (2013.01); *C23C 30/005* (2013.01); *E21B 4/02* (2013.01); *E21B 49/10* (2013.01); *F03C 2/08* (2013.01); *F04C 13/008* (2013.01); *F04C 2/1071* (2013.01); *F04C 2230/91* (2013.01)

(58) Field of Classification Search

CPC ..... E21B 10/46; E21B 4/02; E21B 43/10; E21B 17/1085; E21B 4/003

USPC ..... 175/57, 107, 320, 92; 166/380, 242.1; 216/39

See application file for complete search history.

(56) References Cited

U.S. PATENT DOCUMENTS

| | | | |
|---|---|---|---|
| 4,369,098 | A | 1/1983 | Van Roeyen |
| 4,601,916 | A | 7/1986 | Arachtingi |
| 4,666,556 | A | 5/1987 | Fulton et al. |
| 5,168,107 | A | 12/1992 | Tannenbaum |

(Continued)

FOREIGN PATENT DOCUMENTS

| | | |
|---|---|---|
| EP | 0543444 A1 | 5/1993 |
| EP | 1036913 A1 | 9/2000 |

OTHER PUBLICATIONS

International Preliminary Report on Patentability for International Application No. PCT/US2012/048560 dated Jan. 28, 2014, 6 pages.

(Continued)

*Primary Examiner* — Nicole Coy
(74) *Attorney, Agent, or Firm* — TraskBritt

(57) ABSTRACT

A method for forming a coating upon a wellbore tool includes forming a pattern of features supported by a body and forming a coating over the pattern of features. Forming the pattern of features includes forming a first feature and forming a second feature spaced from the first feature by a first width at a first elevation and by a second width at a second elevation, the second width being different than the first width, and the first elevation being further from an interior region of the body than the second elevation. Also disclosed is a wellbore tool comprising a coating covering a pattern of features and a method of utilizing a wellbore tool in a subterranean formation, the method including forming a pattern of features, forming a coating over the pattern of features, and disposing the wellbore tool in a borehole.

20 Claims, 10 Drawing Sheets

(56) References Cited

U.S. PATENT DOCUMENTS

| | | | |
|---|---|---|---|
| 5,171,138 | A | 12/1992 | Forrest |
| 5,366,923 | A | 11/1994 | Beyer et al. |
| 6,260,636 | B1 | 7/2001 | Cooley et al. |
| 6,271,147 | B1 | 8/2001 | Tseng |
| 6,593,687 | B1 | 7/2003 | Pei et al. |
| 7,060,589 | B2 | 6/2006 | Sato et al. |
| 7,255,328 | B2 | 8/2007 | Hunter |
| 7,364,835 | B2 | 4/2008 | Bhave et al. |
| 7,368,396 | B2 | 5/2008 | Mrvos et al. |
| 7,413,987 | B2 | 8/2008 | Hieda et al. |
| 2001/0019744 | A1 | 9/2001 | Meyer et al. |
| 2002/0076161 | A1 | 6/2002 | Hirabayashi et al. |
| 2002/0098611 | A1 | 7/2002 | Chang et al. |
| 2003/0010540 | A1 | 1/2003 | Kirk et al. |
| 2003/0148539 | A1 | 8/2003 | van Dam et al. |
| 2004/0108587 | A1 | 6/2004 | Chudzik et al. |
| 2005/0033412 | A1 | 2/2005 | Wu et al. |
| 2006/0151855 | A1 | 7/2006 | Kiyotoshi et al. |
| 2006/0155017 | A1 | 7/2006 | Devadoss et al. |
| 2006/0178020 | A1 | 8/2006 | Hoshi et al. |
| 2006/0183349 | A1 | 8/2006 | Farnworth et al. |
| 2007/0015093 | A1 | 1/2007 | Yoo et al. |
| 2007/0045780 | A1 | 3/2007 | Akram et al. |
| 2008/0248240 | A1 | 10/2008 | Shi |
| 2009/0011141 | A1 | 1/2009 | Carter et al. |
| 2009/0017242 | A1* | 1/2009 | Weber et al. ..... 428/35.7 |
| 2009/0255729 | A1 | 10/2009 | Georgi et al. |
| 2010/0148325 | A1 | 6/2010 | Gruenhagen et al. |
| 2010/0258524 | A1 | 10/2010 | Remiat et al. |
| 2011/0174548 | A1 | 7/2011 | Patel et al. |

OTHER PUBLICATIONS

International Search Report for International Application No. PCT/US2012/048560 dated Feb. 19, 2013, 3 pages.

Written Opinion of the International Search Authority for International Application No. PCT/US2012/048560 dated Feb. 19, 2013, 5 pages.

ASTM Standard D7334-08 (Standard Practice for Surface Wettability of Coatings, Substrates and Pigments by Advancing Contact Angle Measurement, ASTM Int'l, West Conshohocken, PA, (2008) 3 pages.

Bakir et al., Integrated Electrical, Optical, and Thermal High Density and Compliant Wafer-Level Chip I/O Interconnections for Gigascale Integration, Electronic Components and Technology Conference, 2004, pp. 1-6.

* cited by examiner

METHODS OF COATING WELLBORE TOOLS AND COMPONENTS HAVING SUCH COATINGS

FIELD

Embodiments of the present disclosure relate to methods used to provide a coating on a wellbore tool and to wellbore tools including such coatings.

BACKGROUND

Wellbores are formed in subterranean formations for various purposes including, for example, extraction of oil and gas from the subterranean formation and extraction of geothermal heat from the subterranean formation. Wellbores may be formed in a subterranean formation using a drill bit such as, for example, an earth-boring rotary drill bit. Different types of earth-boring rotary drill bits are known in the art including, for example, fixed-cutter bits (which are often referred to in the art as "drag" bits), rolling-cutter bits (which are often referred to in the art as "rock" bits), diamond-impregnated bits, and hybrid bits (which may include, for example, both fixed cutters and rolling cutters). The drill bit is rotated and advanced into the subterranean formation. As the drill bit rotates, the cutters or abrasive structures thereof cut, crush, shear, and/or abrade away the formation material to form the wellbore. A diameter of the wellbore drilled by the drill bit may be defined by the cutting structures disposed at the largest outer diameter of the drill bit or by a reamer, if any, included in the drilling system.

The drill bit is coupled, either directly or indirectly, to an end of what is referred to in the art as a "drill string," which comprises a series of elongated tubular segments connected end-to-end that extends into the wellbore from the surface of the formation. Various tools and components, including the drill bit, may be coupled together at the distal end of the drill string at the bottom of the wellbore being drilled. This assembly of tools and components is referred to in the art as a "bottom hole assembly" (BHA).

A drill string and/or BHA may include a number of components in addition to a downhole motor and drill bit, including, without limitation, drill pipe, drill collars, stabilizers, measuring while drilling (MWD) equipment, logging while drilling (LWD) equipment, downhole communication modules, and other components. Further, other tool strings may be disposed in an existing wellbore for, among other operations, completing, testing, stimulating, producing, and remediating hydrocarbon-bearing formations.

In operation, the drill bit may be rotated within the wellbore by rotating the drill string from the surface of the formation, or the drill bit may be rotated by coupling the drill bit to a downhole motor, which is also coupled to the drill string and disposed proximate the bottom of the wellbore. The downhole motor may comprise, for example, a hydraulic Moineau-type motor having a shaft to which the drill bit is mounted. The drill bit may be caused to rotate by pumping fluid (e.g., drilling mud or fluid) from the surface of the formation down through the center of the drill string, through the hydraulic motor, out from nozzles in the drill bit, and back up to the surface of the formation through the annular space between the outer surface of the drill string and the exposed surface of the formation within the wellbore. The downhole motor may be operated in conjunction with, or without, drill string rotation.

The bodies of downhole tools, such as drill bits and reamers, are often provided with fluid courses, such as "junk slots," to allow drilling mud (which may include drilling fluid and formation cuttings generated by the tools that are entrained within the fluid) to pass upwardly around the bodies of the tools into the annular space within the wellbore above the tools outside the drill string. Drilling tools used for casing and liner drilling usually have smaller fluid courses and are particularly prone to balling, which results in a lower rate of penetration.

When drilling a wellbore, the formation cuttings may adhere to, or "ball" on, the surface of the drill bit. The cuttings may accumulate on the cutting elements and the surfaces of the drill bit or other tool and may collect in any void, gap, recess, or crevice between the various components of the bit. This phenomenon is particularly enhanced in formations that fail plastically, such as in certain shales, mudstones, siltstones, limestones, and other relatively ductile formations. The cuttings from such formations may become mechanically packed in the voids, gaps, recesses, or crevices on the wellbore tool.

In other cases, such as when drilling certain shale formations, the adhesion between formation cuttings and a surface of a drill bit or other tool may be at least partially based on chemical bonds therebetween. When a surface of a wellbore tool becomes wet with water in such formations, the tool surface and clay layers of the shale may share common electrons. A similar sharing of electrons is present between the individual sheets of the shale itself. A result of this sharing of electrons is an adhesive-type bond between the shale and the tool surface. Adhesion between the formation cuttings and the bit surface may also occur when the charge of the tool surface is opposite the charge of the formation. The oppositely charged formation particles may adhere to the surface of the tool. Moreover, particles of the formation may be compacted onto surfaces of the tool or mechanically bonded into pits or trenches etched into the tool by erosion and abrasion during the drilling process.

In some cases, drilling operations are conducted with reduced or mitigated hydraulics, which tend to result in the aforementioned balling problems. For example, some drilling rigs may not have pumps with sufficient capacity to provide desirable pressures and flow rates of drilling fluid for drilling to the depths required. Furthermore, operators sometimes find it too costly to run higher mud flow rates or find that high flow rates cause unacceptable wear and erosion of the BHA.

Because of the prolonged contact of wellbore tools with pressurized fluids and debris, in addition to the generally-harsh conditions of a downhole location, when drilling, completing, testing, stimulating, producing or remediating a wellbore, surfaces of drill bits, drill strings, tool string, and components thereof become damaged due to erosion, abrasion, and/or corrosion. Damage may occur on interior and/or exterior surfaces of such components. Such damage may lead to corrosion and premature failure of such components and to additional costs associated with removal and repair or replacement of damaged components.

Coatings are often provided on wellbore tools, such as drill bits, downhole motor power sections, and sensors, to protect the tools from the harsh environments in which they are used. Coatings are often provided on wellbore tools also to enhance an interface or operative connection between one tool surface and another.

BRIEF SUMMARY

In some embodiments, the present disclosure includes a method for forming a coating upon a wellbore tool, the method comprising forming a body comprising an outer surface and an interior region, forming a pattern of features supported by the body, and forming a coat over the pattern of features. The method may not include applying an adhesive between the body and the coating.

In other embodiments, the present disclosure includes a wellbore tool comprising a body having an outer surface and an interior region, a pattern of features defined in at least a portion of the outer surface of the body, and a coating covering the pattern of features. The wellbore tool may or may not include an adhesive between the body and the coating.

In other embodiments, the present disclosure includes a method of utilizing a wellbore tool in a subterranean formation. The method includes forming a wellbore tool, and forming the wellbore tool includes forming a body, forming a pattern of features supported by the body, and forming a coat over the pattern of features. Forming a coat over the pattern of features may or may not include applying an adhesive between the body and the coating. The method of utilizing the wellbore tool includes disposing the wellbore tool in a borehole.

BRIEF DESCRIPTION OF THE DRAWINGS

While the specification concludes with claims particularly pointing out and distinctly claiming what are regarded as embodiments of the disclosure, various features and advantages of this disclosure may be more readily ascertained from the following description of example embodiments provided with reference to the accompanying drawings.

FIG. 1A is a perspective view of the body during a first processing stage.

FIG. 1B is a cross-sectional view of the body taken along Section Line 1B-1B in FIG. 1A.

FIG. 1C is a perspective view of the body during a second processing stage.

FIG. 1D is a cross-sectional view of the body taken along Section Line 1D-1D in FIG. 1C.

FIG. 1E is a perspective view of the body during a third processing stage.

FIG. 1F is a cross-sectional view of the body taken along Section Line 1F-1F in FIG. 1E.

FIG. 2A is a perspective view of the body during a first processing stage.

FIG. 2B is a cross-sectional view of the body taken along Section Line 2B-2B in FIG. 2A.

FIG. 2C is a perspective view of the body during a second processing stage.

FIG. 2D is a cross-sectional view of the body taken along Section Line 2D-2D in FIG. 2C.

FIG. 2E is a perspective view of the body during a third processing stage.

FIG. 2F is a cross-sectional view of the body taken along Section Line 2F-2F in FIG. 2E.

FIG. 3A is a perspective view of the body during a first processing stage.

FIG. 3B is a cross-sectional view of the body taken along Section Line 3B-3B in FIG. 3A.

FIG. 3C is a perspective view of the body during a second processing stage.

FIG. 3D is a cross-sectional view of the body taken along Section Line 3D-3D in FIG. 3C.

FIG. 3E is a perspective view of the body during a third processing stage.

FIG. 3F is a cross-sectional view of the body taken along Section Line 3F-3F in FIG. 3E.

FIG. 4A is a perspective view of the body during a first processing stage.

FIG. 4B is a cross-sectional view of the body taken along Section Line 4B-4B in FIG. 4A.

FIG. 4C is a perspective view of the body during a second processing stage.

FIG. 4D is a cross-sectional view of the body taken along Section Line 4D-4D in FIG. 4C.

FIG. 4E is a perspective view of the body during a third processing stage.

FIG. 4F is a cross-sectional view of the body taken along Section Line 4F-4F in FIG. 4E.

DETAILED DESCRIPTION

Figure 1A:
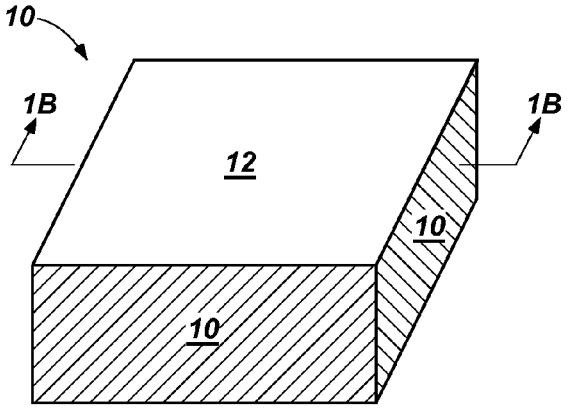
FIGS. 1A-1F are schematic views of a portion of a body during various stages of processing according to a first embodiment of a method of the present disclosure.

As used herein, the term "body" means and includes a structure upon which or in which features may be formed. The body may comprise any of a number of materials, such as a polymer material, a ceramic material, a metal material, or a composite material. The body may be, for example and without limitation, a solid mass, a wall, a floor, a housing, a layer on another object, etc.

As used herein, the term "feature" means and includes a distinct part of a pattern. For example, without limitation, a "feature," as used herein, may include a hole, a cavity, a divot, a notch, a nook, a depression, a trench, a groove, an extension, a pillar, a mound, a bump, a detent, a ridge, a ledge, or the like.

As used herein, the term "wellbore tool" means and includes any article, tool or component to be used within a wellbore in a subterranean formation. Wellbore tools include, without limitation, tools and components used in testing, surveying, drilling, enlarging, completing, sampling, monitoring, utilizing, maintaining, repairing, etc., a wellbore.

As used herein, the term "wellbore" means a man-made conduit formed in a subterranean formation or series of formations for any purpose, such as extraction of oil or gas from the subterranean formation, or extraction of geothermal heat from the subterranean formation.

As used herein, the term "etchant" means and includes matter that is capable of chemically removing material from a solid body. An "isotopic etchant" means and includes an etchant that removes material from a solid surface at substantially equal rates in all directions, as opposed to an "anisotropic etchant," which means and includes an etchant that removes material from a solid surface at a rate that varies with direction.

As used herein, the terms "first," "second," "third," etc., may describe various elements, components, regions, features, widths, cavities, spaces, elevations, trenches, extensions, pillars, ridges, and/or the like, none of which are limited by these terms. These terms are used only to distinguish one element, component, region, feature, width, cavity, space, elevation, trench, extension, pillar, ridge, and the like, from another element, component, region, feature, width, cavity, space, elevation, trench, extension, pillar, ridge, and the like.

The illustrations presented herein are not meant to be actual views of any particular method, tool, component, structure, device, or system, but are merely idealized representations that are employed to describe embodiments of the present disclosure.

The following description provides specific details, such as material types, material thicknesses, and processing conditions in order to provide a thorough description of embodiments of the disclosed devices and methods. However, a person of ordinary skill in the art will understand that the embodiments of the devices and methods may be practiced without employing the specific details. Indeed, the embodiments of the devices and methods may be practiced in conjunction with conventional fabrication techniques employed in the industry.

Reference will now be made to the drawings, wherein like numerals refer to like components throughout. The drawings are not necessarily drawn to scale.

In some embodiments, the disclosure includes a method for forming a coating upon a wellbore tool. A body is formed or otherwise provided, which has an outer surface and an interior region. A pattern of features is formed or otherwise provided on or in the outer surface of the body. A coating is formed over the pattern of features.

The features of the pattern may be selectively formed in an ordered array on the surface of the body. In other words, the features are not formed at random locations, as are surface roughness features formed by conventional grit blasting or other surface roughening techniques. In contrast, the features are selectively formed to have a desired size and shape, and are formed at selected locations on the body. Further, the features may be formed to have a shape that will serve to mechanically interlock the coating on the surface of the body. An adhesive may or may not be included between the body and the coating.

Forming the pattern of features involves forming a pattern having a first region and a lower second region. The width of the features differs in the first region from the width of the features in the second region, as does the width of the space or material separating the features from one another. Applying a coating fills the otherwise-empty space with coating material, resulting in a width of each segment of coating material occupying the lower, second region of the pattern being wider than the width of each segment of coating material occupying the higher, first region of the pattern. The features may have a shape that, once the coating has been formed on the body over the features, will result in mechanical interference between the coating and surfaces of the features. Such mechanical interference will hinder separation of the coating from the surface of the body.

The features of the pattern may be formed by either removing material from the body or by adding material to the body's surface. FIGS. 1A through 1F and 2A through 2F depict processing stages of embodiments of a method for forming a coating upon a body in which material is removed from a body to form a pattern of features. FIGS. 3A through 3F and 4A through 4F depict a method in which material is either added to or removed from a body to form a pattern of features.

FIGS. 1A through 1F depict processing stages of a method for forming a coating upon a body in accordance with a first embodiment of the present disclosure. The method includes forming a pattern of features by removing portions (e.g., segments) of the body.

Figure 1B:
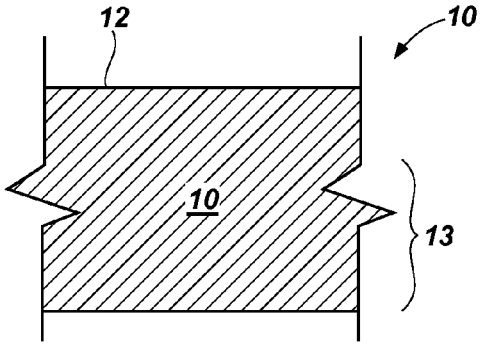

With reference to FIGS. 1A and 1B, the present method includes forming or otherwise providing a body 10 that is to be provided with a coating thereon. The body 10 includes an exterior surface 12 and an interior region 13. The interior region 13 is any region of the body 10 inward of the exterior surface 12. In forming a body 10 that is a solid object, the exterior surface 12 may be the exterior surface of the solid object and the interior region 13 may be the interior material of the object. In forming a body 10 that is a wall of a tool, the exterior surface 12 may be the exterior surfaces of the wall, and the interior region 13 may be the interior material within the wall. The interior region 13 is not necessarily proximate to the center of an assembly or tool, itself, but is proximate to the center of the wall, of the assembly, to be coated.

Figure 1C:
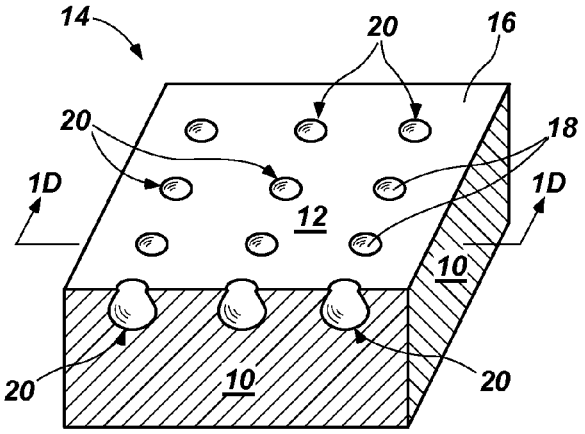
Figure 1D:
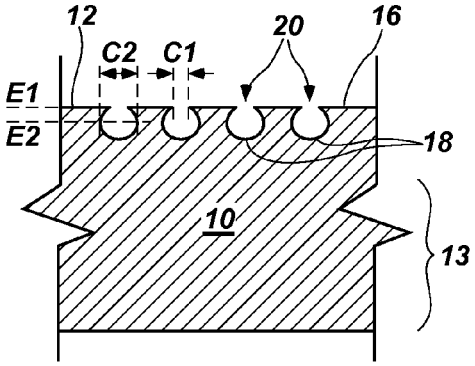

With reference to FIGS. 1C and 1D, the method includes forming a pattern 14 of features. The features may comprise cavities 20, each formed by removing material from the body 10 at the exterior surface 12. The material may be removed from the body 10 using any suitable technique, including, but not limited to, etching, powder blasting, laser irradiation, or the like.

By way of example and not limitation, forming the cavities 20 may include selectively exposing at least a portion of the exterior surface 12 of the body 10 to laser irradiation to remove segments of material from the exterior surface 12. The laser irradiation may be used in association with a mask incorporating a mask pattern coordinated to the desired pattern 14 of cavities 20. One of ordinary skill in the art is capable of selecting, setting, and utilizing the appropriate materials and/or parameters to form cavities 20 of the desired geometry and layout utilizing a conventional laser irradiation technique.

Alternatively or additionally, forming the cavities 20 may include exposing at least portions of the exterior surface 12 of the body 10 to a chemical etchant to remove material therefrom. The etchant may be a gas, liquid, solid, or a combination thereof or require an additional energy source such as electromagnetic radiation or electrons. Either dry (e.g., plasma) or wet (e.g., chemical) etching techniques may be used. The etchant may be an isotropic etchant. The etchant may be used in association with a photomask incorporating a pattern coordinated to the desired pattern 14 of cavities 20. One of ordinary skill in the art is capable of selecting and applying an appropriate etchant utilizing a conventional etching technique to form cavities 20 of the desired geometry and layout.

Alternatively or additionally, forming the cavities 20 may include exposing at least portions of the exterior surface 12 of the body 10 to a mechanical, material-removing process to remove material therefrom. For example, without limitation, forming the cavities 20 may include exposing at least portions of the exterior surface 12 of the body 10 to a powder blasting particle jet. The powder blasting particle jet may be used in association with conventional powder blasting techniques including with a blasting mask incorporating a pattern coordinated to the desired pattern 14 of cavities 20. As another example, without limitation, forming the cavities 20 by exposing at least portions of the exterior surface 12 of the body 10 to a mechanical, material-removing process may include utilizing a round-headed drill or router bit so as to form round-bottomed cavities 20 with an upper, overhang edge along the exterior surface 12 of the body 10. One of ordinary skill in the art is capable of selecting, setting, and utilizing the appropriate materials and parameters to form cavities 20 of desired geometry and layout utilizing a conventional mechanical, material-removing process.

Forming the pattern 14 includes forming a first cavity 20, such as by laser irradiation, isotropic etching, or powder blasting, and forming a second cavity 20, by the same or different method, spaced from the first cavity 20. With reference to FIG. 1D, forming each of the first cavity 20 and second cavity 20 may include removing material from the body 10 to form an indentation having a first cavity width C1 at a first elevation E1 and a second cavity width C2 at a second elevation E2. First cavity width C1 may be less than or equal to 10 millimeters. For example, without limitation, first cavity width C1 may be less than or equal to 100 micrometers or less than or equal to 100 nanometers. First elevation E1 may be defined at the exterior surface 12 of the body 10, and second elevation E2 may be defined nearer to the interior region 13 of the body 10, with the depth of each cavity 20 being less than or equal to 10 millimeters. First elevation E1 is further from the interior region 13 than second elevation E2. The second cavity width C2 is different than the first cavity width C1. The second cavity width C2 may be greater than the first cavity width C1 such that the width of the cavity 20 located at second elevation E2 is wider than the width of the cavity 20 located at first elevation E1. Second cavity width C2 may be less than or equal to 10 millimeters. For example, without limitation, second cavity width C2 may be less than or equal to 100 micrometers or less than or equal to 100 nanometers. The cavities 20 are therefore wider in a lower region than in a higher region. Once the cavities 20 are filled with coating material, the coating material will interlock with the remaining body 10 material, and the coating material will be discouraged from dislodging from the cavities 20 and separating from the body 10.

The pattern 14 of cavities 20 may be formed by depositing a photomask on the exterior surface 12 of the body 10 and forming apertures in the photomask with diameters equal to the first cavity width C1 of each cavity 20. The photomask is formed of an etchant-resistant material. Forming the cavities 20 may further include exposing the photomasked exterior surface 12 of the body 10 to an isotropic etchant to isotropically etch the body 10 beneath the apertures in the photomask.

The pattern 14 of cavities 20 may, alternatively, be formed by forming the body 10 to include an impurity gradient in a vicinity of the interior region 13 of the body 10, depositing a photomask on the exterior surface 12, forming apertures in the photomask having diameters equal to the first cavity width C1 of each cavity 20 to be formed, plasma etching a channel from each aperture to the interior region 13, and then isotropically etching the interior region 13 of the body 10 so as to form a lower chamber of each cavity 20 having a width greater than first cavity width C1. The impurity gradient is configured to encourage etching of the regions containing higher concentrations of impurities faster than the regions containing lower concentrations of impurities. Therefore, forming the body 10 so as to have an impurity gradient such that the impurity concentration is highest in the lower areas of the cavities 20 to be formed and lower in the higher areas of the cavities 20 yields a cavity 20 having a smaller width, e.g., first cavity width C1, at the exterior surface 12 of the body 10, and a larger width, e.g., second cavity width C2, nearer to the interior region 13 of the body 10.

Each cavity 20 may be separated from a neighboring cavity 20 by remaining material of the body 10. The second cavity 20 is separated from the first cavity 20 by first ridge width R1 at first elevation E1, wherein first ridge width R1 is equal to the width of the remaining material positioned between the first cavity 20 and the second cavity 20 at first elevation E1. First ridge width R1 may be less than or equal to 10 millimeters. For example, without limitation, first ridge width R1 may be less than or equal to 100 micrometers or less than or equal to 100 nanometers. The second cavity 20 is separated from the first cavity 20 also by second ridge width R2 at second elevation E2, which second ridge width R2 is equal to the width of the remaining material positioned between the first cavity 20 and the second cavity 20 at second elevation E2. Second ridge width R2 may be less than or equal to 10 millimeters. For example, without limitation, second ridge width R2 may be less than or equal to 100 micrometers or less than or equal to 100 nanometers. While each cavity 20 is wider nearer to the interior region 13 of the body 10, the remaining material separating each cavity 20 from a neighboring cavity 20 is wider nearer to the exterior surface 12 of the body 10.

Other cavities 20, in addition to the first cavity 20 and the second cavity 20, may be formed. Forming the pattern 14 may include forming an array of cavities 20 evenly spaced and aligned substantially in parallel columns or rows. Forming the pattern 14 may include forming cavities 20 that are distributed without a particular order along the exterior surface 12 of the body 10. Forming additional features may include removing material from the body 10 in configurations other than cavities 20.

Figure 1E:
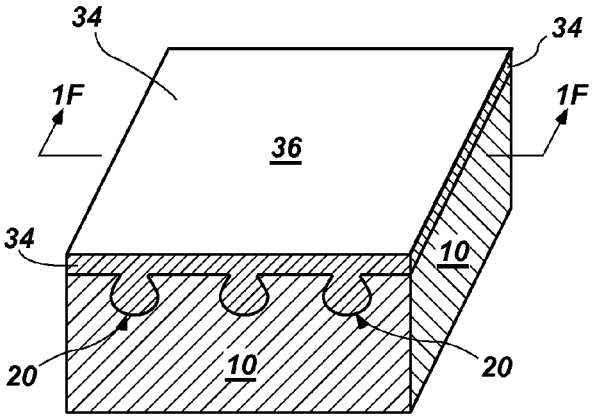
Figure 1F:
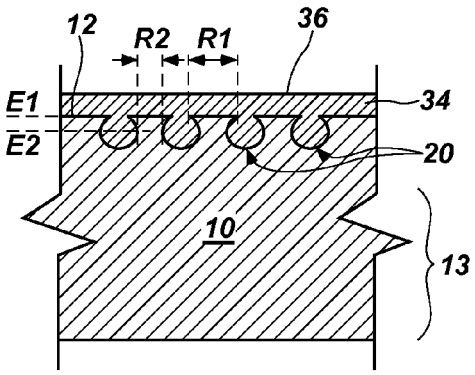

With reference to FIGS. 1E and 1F, the present method further includes forming a coating 34 over the pattern 14 of cavities 20. The coating 34 may be formed by any suitable technique including, but not limited to, evaporation, sputtering, chemical vapor deposition, electroplating, spin coating, spray coating, blanket coating, dip coating, or other techniques familiar to one of ordinary skill in the art of tool coating. The forming technique may be chosen according to the coating material to be formed. For example, a metal coating may be formed by evaporation, sputtering, electroplating, or chemical vapor deposition. An adhesion layer may be included between such metal coating and the pattern 14 of features. An adhesion layer may be formed of chromium, gold, or the like. Alternatively, an adhesion layer may not be included between a metal coating and the pattern 14. A polymer coating may be formed by spin coating or spray coating. Depending on the specific coating material to be formed, the technique for forming the coating may be selected by a person of ordinary skill in the art. The material comprising the coating 34 may be a polymer, a metal, or a combination thereof. Such a polymer may be, without limitation, an epoxy, a resin, or a thermoplastic. A ceramic coating or a cermet coating (i.e., a coating comprising both ceramic and metallic materials) may alternatively or additionally be formed over the pattern 14 of features. One of ordinary skill in the art is capable of selecting and applying appropriate coating material and techniques to form the coating 34 over the pattern 14.

Forming the coating 34 over the pattern 14 may include applying the coating 34 to occupy the space previously occupied by the removed material, covering the second region 18 of the pattern 14. Forming the coating 34 over the pattern 14 may further include applying the coating material to overlay at least portions of the exterior surface 12 of the body 10, covering the first region 16 of the pattern 14. Forming the coating 34 to occupy the space defined by the cavities 20 and to cover the exterior surface 12 of the body 10 may be accomplished simultaneously or in separate stages such as by forming a first segment of the coating 34 to at least partially fill the cavities 20 and then by forming a second segment of coating 34 to cover the exterior surface 12 of the body 10. The first segment and second segment of the coating 34 may be formed of the same material or of different materials.

With continued reference to FIGS. 1E and 1F, in forming the coating 34, the material of the coating 34 may be formed within each cavity 20 such that material of the coating 34 at second elevation E2 will have a width greater than material of the coating 34 at first elevation E1. Material of the coating 34 formed within each cavity 20 may be seamlessly connected with material of the coating 34 formed over the exterior surface 12 of the body 10. The coating 34 may be formed to conformally overlay the first region 16 of the pattern 14 and the second region 18 of the pattern 14. The coating 34 may be formed so that the coating 34 coats the entirety of the exterior surface 12 of the body 10. Alternatively, the coating 34 may be formed so that the coating 34 coats only portions of the exterior surface 12 of the body 10.

The formed coating 34 includes a coating surface 36. The coating surface 36 may be smooth, having a local topographical change in elevation that is less than the total elevation difference between the first region 16 and the second region 18 of the pattern 14.

The coating 34 may be formed directly on the pattern 14 of features without first including an adhesive between the coating 34 and the exterior surface 12 of the body 10. In other embodiments, an adhesive may be included therebetween.

The coating 34 may be topologically modified after forming. For example, the coating 34 may be planarized, as by the use of an abrasive technique such as chemical mechanical polishing. Alternatively or additionally, the coating 34 may be subjected to a molding technique or other surface modification technique to modify the topology of the coating surface 36. Such techniques may be used to form specific additional features supported by the coating surface 36.

FIGS. 2A through 2F depict processing stages of a method for forming a coating upon a body in accordance with a second embodiment of the present method. As with the first embodiment of the present method, the second embodiment includes forming a pattern of features by removing segments of the body. In accordance with the second embodiment, material is removed to form elongated trenches 22, rather than multiple cavities 20.

Figure 2A:
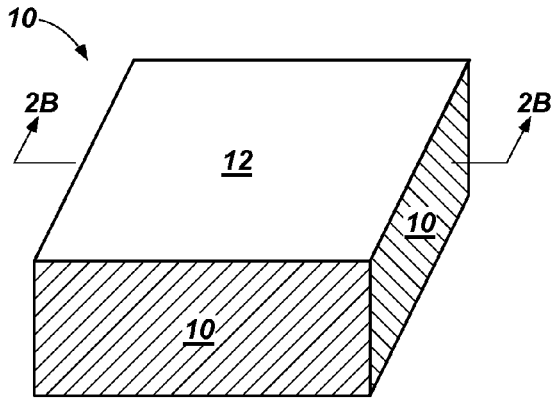
FIGS. 2A-2F are schematic views of a portion of a body during various stages of processing according to a second embodiment of a method of the present disclosure.
Figure 2B:
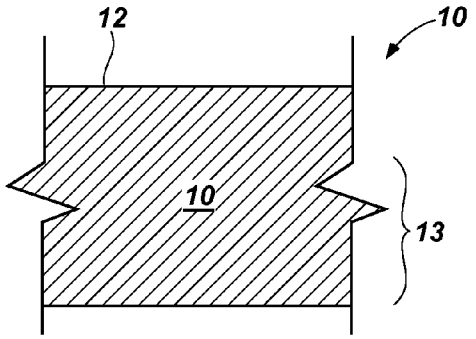
Figure 2C:
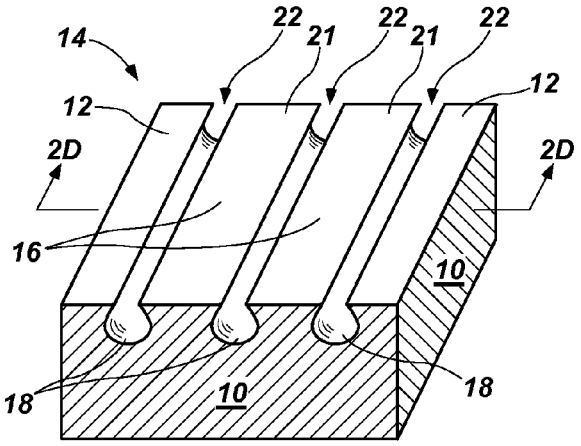
Figure 2D:
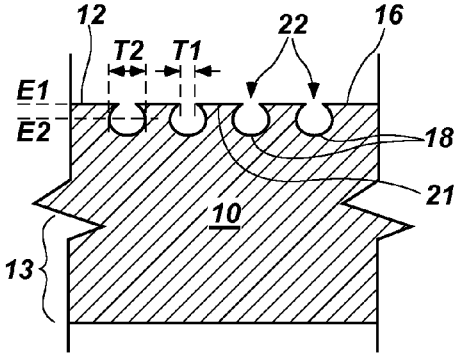
Figure 2E:
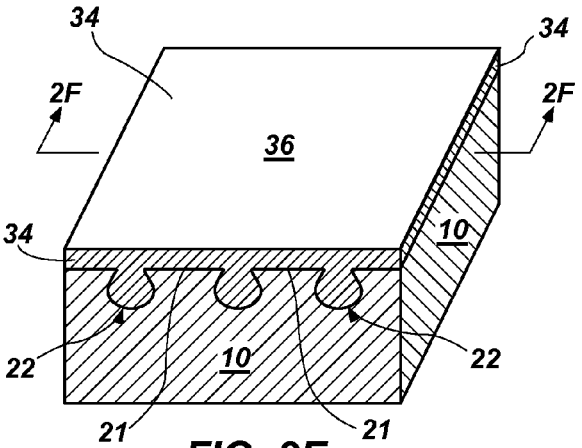
Figure 2F:
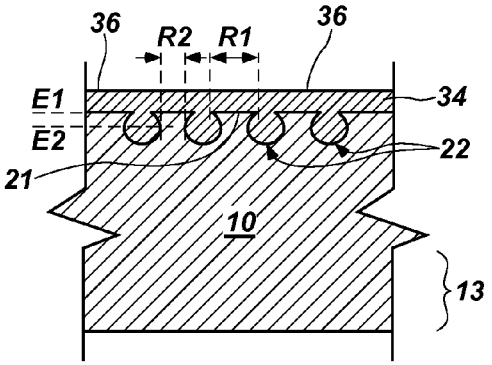

With reference to FIGS. 2A through 2D, the present method includes forming a body 10 having an exterior surface 12 and an interior region 13 (FIGS. 2A and 2B) and forming a pattern 14 of features (FIGS. 2C and 2D). Forming the pattern 14 of features includes forming trenches 22 by removing material from the body 10 at the exterior surface 12. The material may be removed using any of the methods previously described with reference to FIGS. 1C and 1D. One of ordinary skill in the art is capable of selecting and utilizing an appropriate material-removing technique to form trenches 22 of the desired geometry and layout.

Forming the pattern 14 includes forming a first trench 22 and forming a second trench 22, by the same or different method, spaced from the first trench 22. Each trench 22 may be spaced from another trench 22 by a ridge 21. With reference to FIG. 2D, forming each of the first trench 22 and second trench 22 may include removing material from the body 10 so as to form an indentation defining a first trench width T1 at a first elevation E1 and a second trench width T2 at a second elevation E2. First trench width T1 may be less than or equal to 10 millimeters. For example, without limitation, first trench width T1 may be less than or equal to 100 micrometers or less than or equal to 100 nanometers. First elevation E1 may be defined at the exterior surface 12 of the body 10, and second elevation E2 may be defined nearer to the interior region 13 of the body 10, with the depth of each trench 22 being less than or equal to 10 millimeters. First elevation E1 is further from the interior region 13 than second elevation E2. The second trench width T2 is different than the first trench width T1. The second trench width T2 may be greater than the first trench width T1, such that the width of the trench 22 located at second elevation E2 is wider than the width of the trench 22 located at first elevation E1. Second trench width T2 may be less than or equal to 10 millimeters. For example, without limitation, second trench width T2 may be less than or equal to 100 micrometers or less than or equal to 100 nanometers. The trenches 22 are therefore wider in a lower region than in a higher region. Once the trenches 22 are filled with coating material, the coating material will interlock with the remaining body 10 material, and the coating material will be discouraged from dislodging from the trenches 22 and separating from the body 10.

With particular reference to FIG. 2D, the cross-sectional geometry of each trench 22 may be the same as the cross-sectional geometry of each cavity 20 formed utilizing a method according to the first embodiment (FIG. 1D).

Other trenches 22 in addition to the first trench 22 and the second trench 22 may be formed. Forming the pattern 14 may include forming an array of trenches 22 evenly spaced and aligned substantially in parallel. Forming the pattern 14 may include forming trenches 22 distributed without particular order along the exterior surface 12 of the body 10 and/or intersecting with one another. Forming additional features may include removing material from the body 10 in configurations other than trenches 22. Forming the pattern 14 may include forming trenches 22 in accordance with the second embodiment of the method and forming cavities 20 in accordance with the first embodiment of the method.

The remaining processing stages may be the same as those with the first embodiment, such that the coating 34 may be formed as previously described with reference to FIGS. 1E and 1F.

FIGS. 3A through 3F depict processing stages of a method for forming a coating upon a body in accordance with a third embodiment of the present disclosure. Unlike the first two embodiments, the method of the third embodiment includes forming a pattern of features by either adding portions (e.g., segments) to the body or removing portions from the body to define isolated extensions.

Figure 3A:
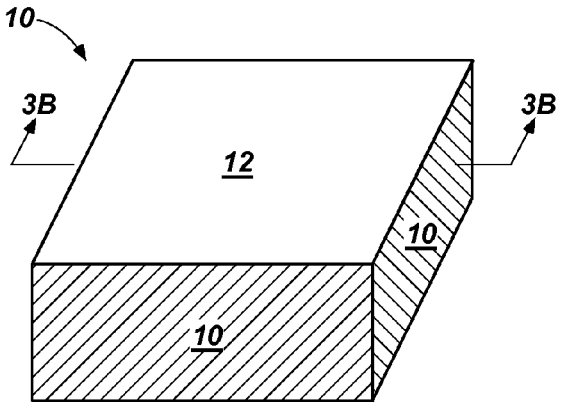
FIGS. 3A-3F are schematic views of a portion of a body during various stages of processing according to a third embodiment of a method of the present disclosure.
Figure 3B:
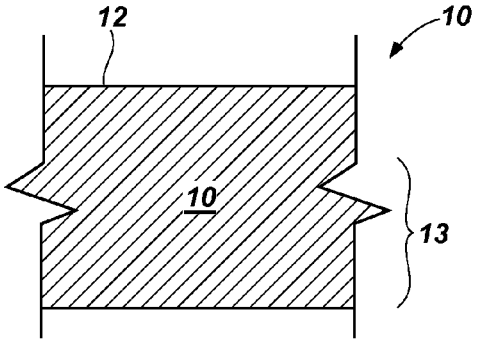
Figure 3C:
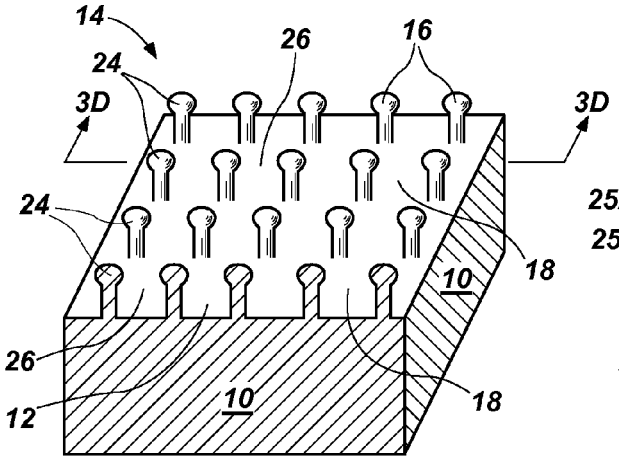
Figure 3D:
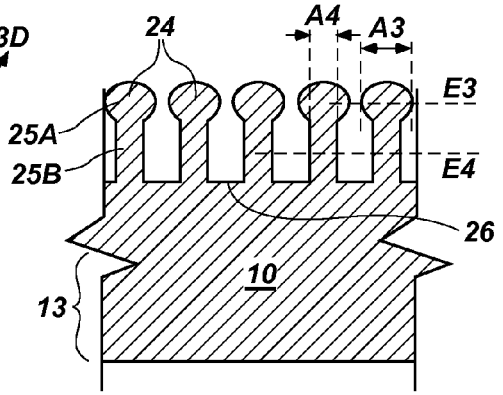
Figure 3E:
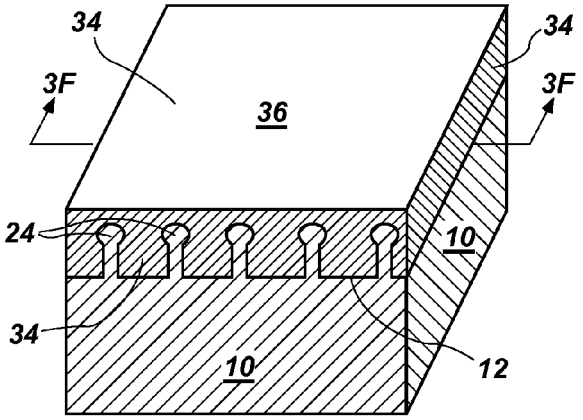
Figure 3F:
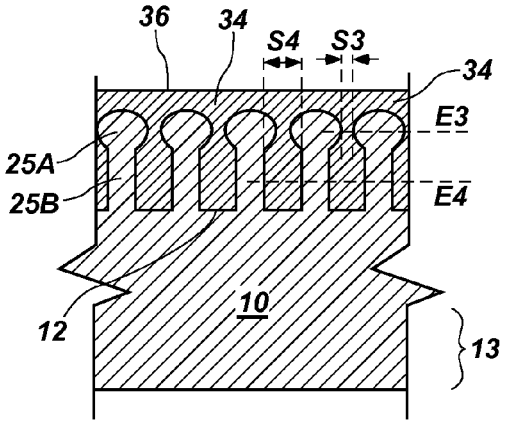

With reference to FIGS. 3A through 3D, the present method includes forming a body 10 having an exterior surface 12 and an interior region 13 (FIGS. 3A and 3B) and forming a pattern 14 of features (FIGS. 3C and 3D). Forming the features of the pattern 14 includes forming extensions directed perpendicularly upward from the exterior surface 12 of the body 10. The extensions may include pillars 24, each formed by adding material to the exterior surface 12 of the body 10. Forming the pillars 24 may include selectively depositing material at desired locations on the exterior surface 12 of the body 10, growing material at the desired locations, or molding additional material at the desired locations. Alternatively, forming the pillars 24 may include removing all but selective segments of material from the body 10 to leave isolated pillars 24. In either regard, forming the pattern 14 of the present embodiment includes forming a first region 16 of the pattern 14 including at least upper portions of extension such as pillars 24 and forming a second region 18 of the pattern 14 including a depressed floor 26. The depressed floor 26 may include portions of the exterior surface 12 of the body 10. One of ordinary skill in the art is capable of selecting and utilizing the appropriate material-removal or material-adding technique to form pillars 24 of the desired geometry and layout.

Forming the pattern 14 includes forming a first pillar 24 and forming a second pillar 24, using the same or different method. The second pillar 24 is formed spaced from the first pillar 24. With reference to FIG. 3D, forming each of the first pillar 24 and second pillar 24 may include adding material to the exterior surface 12 of the body 10 to form upstanding extensions having a head 25A supported by a stem 25B. Each of the first pillar 24 and second pillar 24 are formed so as to define a first extension width A3 at first elevation E3 and a second extension width A4 at a second elevation E4. The head 25A may be located at first elevation E3, and the stem 25B may be located at second elevation E4. The first extension width A3 may be defined by the width of the head 25A of the pillar 24, and the second extension width A4 may be defined by the width of the stem 25B of the pillar 24. First extension width A3 may be less than or equal to 10 millimeters. For example, without limitation, first extension width A3 may be less than or equal to 100 micrometers or less than or equal to 100 nanometers. Second elevation E4 may be defined at the exterior surface 12 of the body 10, and first elevation E3 may be defined further from the exterior surface 12, with the height of each pillar 24 being less than or equal to 10 millimeters. First elevation E3 is further from the interior region 13 than second elevation E4. The first extension width A3 is different than the second extension width A4. The second extension width A4 may be less than the first extension width A3, such that the width of the pillar 24 located at second elevation E4 is less than the width of the pillar 24 located at first elevation E3. Second extension width A4 may be less than or equal to 10 millimeters. For example, without limitation, second extension width A4 may be less than or equal to 100 micrometers or less than or equal to 100 nanometers.

Each pillar 24 may be separated from a neighboring pillar 24 by a space void of body 10 material. The second pillar 24 is separated from the first pillar 24 by first space width S3 at first elevation E3. First space width S3 may be less than or equal to 10 millimeters. For example, without limitation, first space width S3 may be less than or equal to 100 micrometers or less than or equal to 100 nanometers. The second pillar 24 is separated from the first pillar 24 also by second space width S4 at second elevation E4. Second space width S4 may be less than or equal to 10 millimeters. For example, without limitation, second space width S4 may be less than or equal to 100 micrometers or less than or equal to 100 nanometers. While each pillar 24 is narrower near to the interior region 13 of the body 10, the void space separating each pillar 24 from the neighboring pillar 24 is wider near to the interior surface 13 of the body 10. Once the void space is filled with coating material, the coating material will interlock with the pillars 24, and the coating material will be discouraged from dislodging from between the pillars 24 and separating from the body 10.

Other pillars 24, in addition to the first pillar 24 and the second pillar 24, may also be formed. Forming the pattern 14 may include forming an array of pillars 24 evenly spaced and aligned substantially in parallel columns or rows. Forming the pattern 14 may include forming pillars 24 that are distributed without a particular order upon the exterior surface 12 of the body 10. Forming the pattern 14 of features may include forming additional features including features formed by removing material from the body 10 to create cavities 20 in accordance with the first embodiment (FIGS. 1C and 1D) and/or to create trenches 22 in accordance with the second embodiment (FIGS. 2C and 2D). Forming additional features may include forming extensions and configurations other than pillars 24.

The remaining processing stages may be the same as those with the first and second embodiments, such that the coating 34 may be formed as previously described with reference to FIGS. 1E and 1F.

FIGS. 4A through 4F depict processing stages of the method for forming a coating upon a body in accordance with a fourth embodiment of the present method. As with the third embodiment of the present method, the fourth embodiment includes forming a pattern of features by adding segments of material to the exterior surface of the body or by removing segments of material from the body to define isolated extensions. In accordance with this fourth embodiment, the isolated extensions are formed to be elongated ridges 28, rather than multiple pillars 24.

Figure 4A:
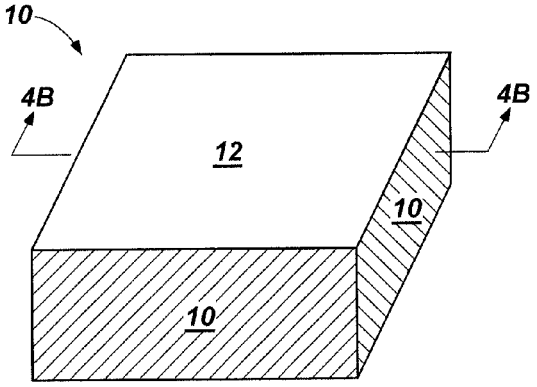
FIGS. 4A-4F are schematic views of a portion of a body during various stages of processing according to a fourth embodiment of a method of the present disclosure.
Figure 4B:
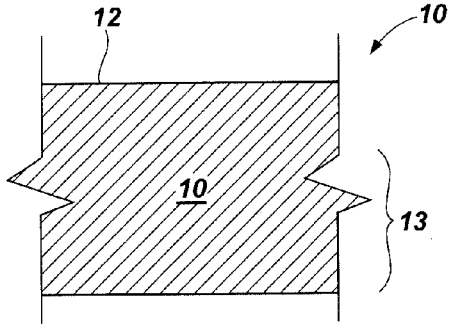
Figure 4C:
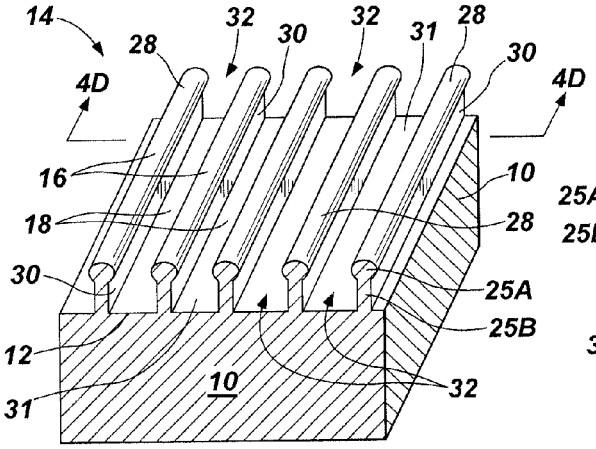
Figure 4D:
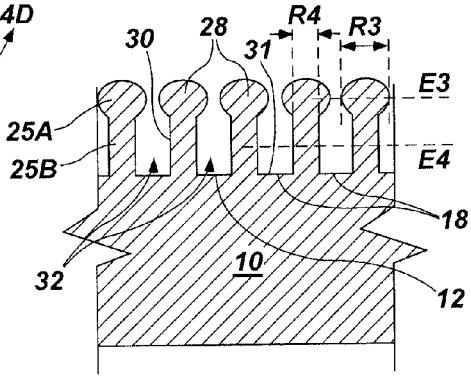
Figure 4E:
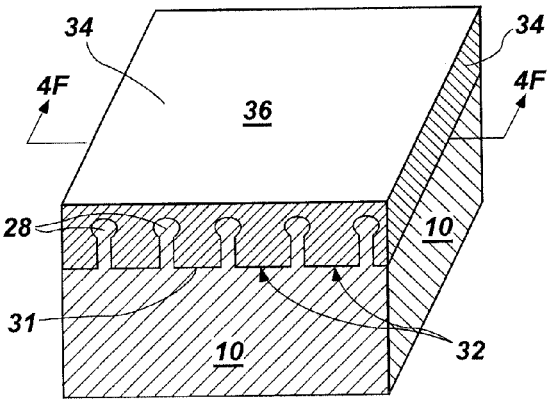
Figure 4F:
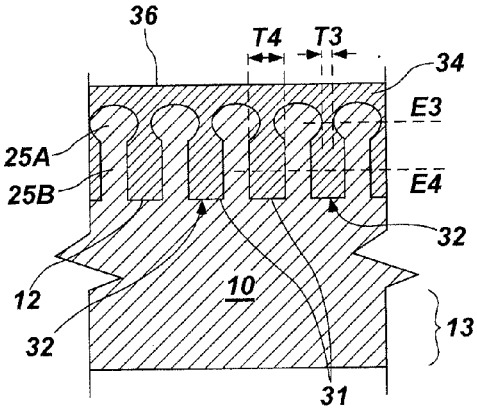

With reference to FIGS. 4A through 4D, the present method includes forming a body 10 having an exterior surface 12 and an interior region 13 (FIGS. 4A and 4B) and forming a pattern 14 of features (FIGS. 4C and 4D). Forming the features of the pattern 14 includes forming extensions directed perpendicularly upward from the exterior surface 12 of the body 10. The extensions may include ridges 28, each formed by adding material to the exterior surface 12 of the body 10 or by removing all but selected segments of material from the body 10 to form isolated ridges 28.

Forming the ridges 28 of the present embodiment includes forming a first region 16 of the pattern 14 comprising at least upper portions of the ridges 28 and forming a second region 18 of the pattern 14 comprising floors 31 of trenches 32 between the ridges 28. The floors 31 may include portions of the exterior surface 12 of the body 10. The material of the ridges 28 may be added or removed using any of the methods previously described with reference to FIGS. 3C and 3D. One of ordinary skill in the art is capable of selecting and utilizing the appropriate material-adding or material-removing technique to form ridges 28 of the desired geometry and layout.

Forming the pattern 14 includes forming a first ridge 28 and forming a second ridge 28 using the same or different method. The second ridge 28 is formed spaced from the first ridge 28. With reference to FIG. 4D, forming each of the first ridge 28 and second ridge 28 may include adding material to the exterior surface 12 of the body 10 to form upstanding extensions having an extending head 25A supported by an extending stem 25B. Each of the first ridge 28 and second ridge 28 are formed to define a first ridge width R3 at first elevation E3 and a second ridge width R4 at second elevation E4. First ridge width R3 may be less than or equal to 10 millimeters. For example, without limitation, first ridge width R3 may be less than or equal to 100 micrometers or less than or equal to 100 nanometers. The extending head 25A may be located at first elevation E3, and the extending stem 25B may be located at second elevation E4. The first ridge width R3 may be defined by the width of the extending head 25A of a ridge 28, and the second ridge width R4 may be defined by the width of the stem 25B of a ridge 28. Second elevation E4 may be defined at the exterior surface 12 of the body 10, and first elevation E3 may be defined further from the exterior surface 12, with the height of each ridge 28 being less than or equal to 10 millimeters. First elevation E3 is further from the interior region 13 than second elevation E4. The first ridge width R3 is different than the second ridge width R4. The second ridge width R4 may be less than the first ridge width R3, such that the width of the ridge 28 located at second elevation E4 is less than the width of the ridge 28 located first elevation E3. Second ridge width R4 may be less than or equal to 10 millimeters. For example, without limitation, second ridge width R4 may be less than or equal to 100 micrometers or less than or equal to 100 nanometers.

With particular reference to FIG. 4D, the cross-sectional geometry of each ridge 28 may be the same as the cross-sectional geometry of each pillar 24 formed utilizing a method according to the third embodiment (FIG. 3D).

Each ridge 28 may be separated from a neighboring ridge 28 by a trench 32 void of body 10 material. Each trench 32 is bordered by a pair of sidewalls 30, one of the sidewalls 30 being defined by the extending stem 25B of the first ridge 28 and the other of the sidewalls 30 being defined by the extending stem 25B of the second ridge 28. The floor 31 of each trench 32 may be a portion of the exterior surface 12 of the body 10. The second ridge 28 is separated from the first ridge 28 by first trench width T3 at first elevation E3. First trench width T3 may be less than or equal to 10 millimeters. For example, without limitation, first trench width T3 may be less than or equal to 100 micrometers or less than or equal to 100 nanometers. The second ridge 28 is separated from the first ridge 28 also by second trench width T4 at second elevation E4. Second trench width T4 may be less than or equal to 10 millimeters. For example, without limitation, second trench width T4 may be less than or equal to 100 micrometers or less than or equal to 100 nanometers. While each ridge 28 is narrower near to the interior region 13 of body 10, the trench 32 separating each ridge 28 from a neighboring ridge 28 is wider near to the interior region 13 of the body 10. Once the trenches 32 are filled with coating material, the coating material will interlock with the ridges 28, and the coating material will be discouraged from dislodging from between the ridges 28 and separating from the body 10.

Other ridges 28, in addition to the first ridge 28 and the second ridge 28, may be formed. Forming the pattern 14 may include forming an array of ridges 28 evenly spaced and aligned substantially parallel to one another. Forming the pattern 14 may include forming ridges 28 that are distributed without a particular order upon the exterior surface 12 of the body 10. Forming the pattern 14 may including forming intersecting ridges 28. Forming the pattern 14 of features may include forming additional features including features formed by removing material from the body 10 to create cavities 20 in accordance with the first embodiment (FIGS. 1C and 1D), to create trenches 22 in accordance with the second embodiment (FIGS. 2C and 2D), and/or to create pillars 24 in accordance with the third embodiment (FIGS. 3C and 3D). Forming additional features may include forming extensions in configurations other than ridges 28.

The remaining processing stages may be the same as those with the first through third embodiments, such that the coating 34 may be formed as previously described with reference to FIGS. 1E and 1F.

Forming a pattern 14 in accordance with any of the first through fourth embodiments may include forming a small-scale pattern. A small-scale pattern includes, without limitation, a three-dimensional topography of features (e.g., cavities, trenches, ridges, extensions, indents, pillars, and the like) having at least one dimension of about 1 millimeter or less, including, for example, 1 micron or less. The small-scale pattern may be disposed on an exterior surface 12 of a body 10 in which the exterior surface 12 is an otherwise flat surface or a surface having an underlying curvature of elements larger than the features of the small-scale pattern.

Figure 5:
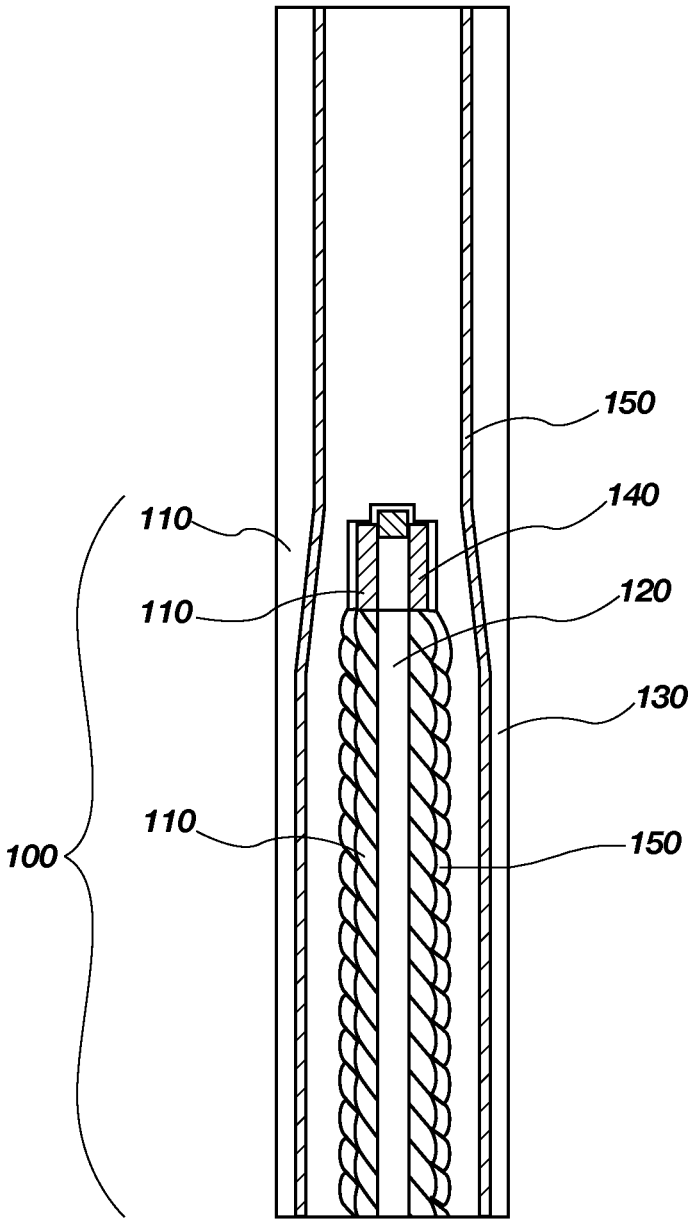
FIG. 5 is a simplified, schematically illustrated cross-sectional view of an embodiment of a component of a wellbore tool comprising a portion of a downhole motor that includes a coating formed in accordance with embodiments of methods as described herein.

FIG. 5 illustrates a wellbore tool of the present disclosure. Depicted is a component of a wellbore tool containing a coating. The wellbore tool may comprise a component of a wellbore tool configured as a downhole Moineau-type "mud" motor. It may include a portion of a power section 100 of a downhole motor. The component of the wellbore tool includes one or more bodies 110, such as a rotor 120, a stator 130, and/or a bypass valve assembly 140. The bodies 110 may include any metal, alloy, or other hard material. One or more surfaces of the bodies 110, for example, one or more surfaces of the rotor 120 and bypass valve assembly 140, may have their own coatings 150 over at least a portion thereof. The coatings 150 may be formed in accordance with the first, second, third, and/or fourth embodiments of the method for forming a coating, as discussed above in reference to FIGS. 1A through 1F, 2A through 2F, 3A through 3F, and 4A through 4F, respectively.

Figure 6:
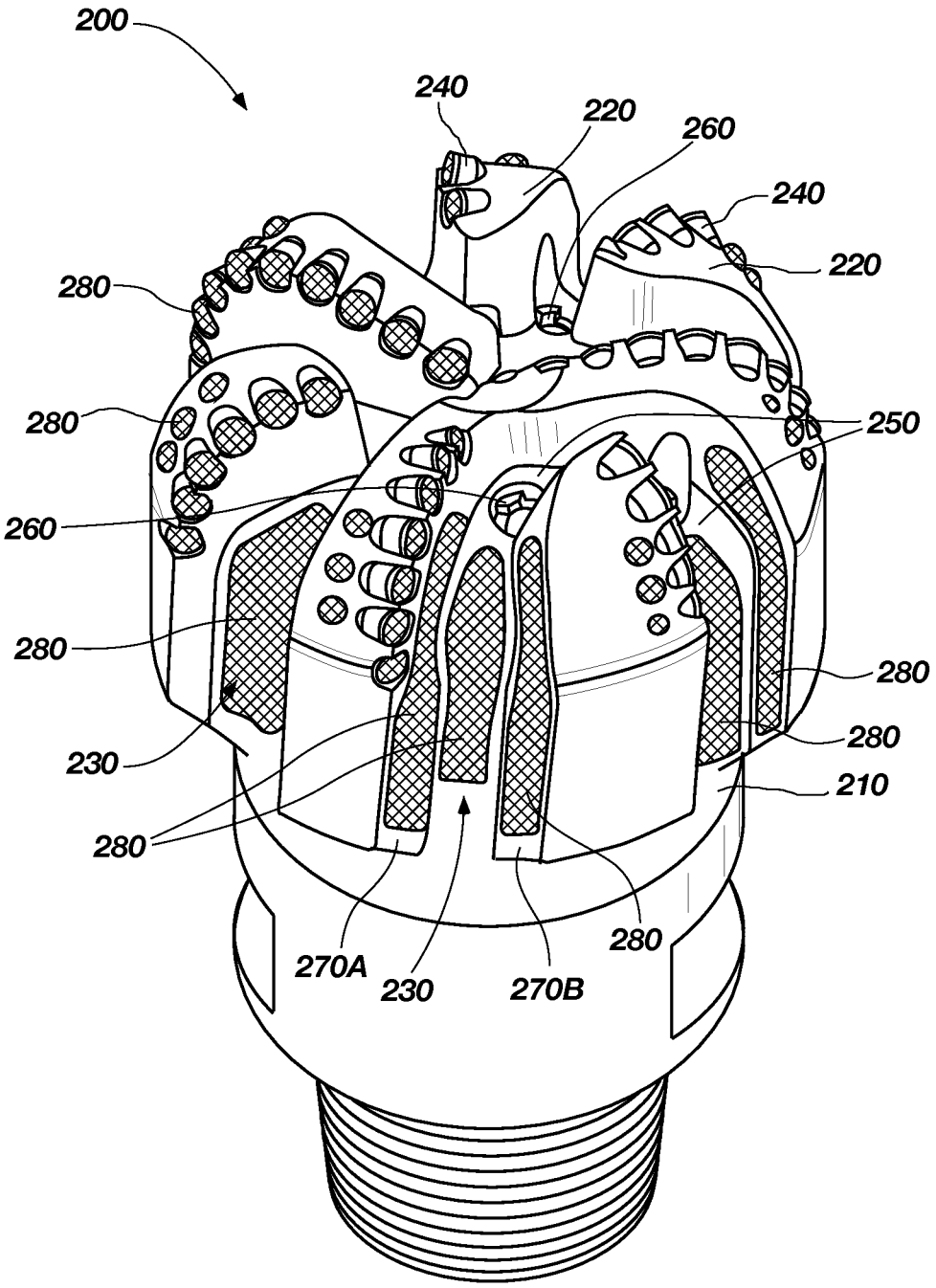
FIG. 6 is a perspective view of an embodiment of an earth-boring tool comprising a rotary fixed-cutter drill bit that includes a coating formed in accordance with embodiments of methods as described herein.

FIG. 6 illustrates another wellbore tool of the present disclosure. Depicted is an earth-boring rotary drill bit 200 having a bit body 210 that includes a plurality of blades 220 separated from one another by fluid courses 230. The portions of the fluid courses 230 that extend along the radial side (the "gage" areas of the drill bit 200) between adjacent blades 220 are often referred to in the art as "junk slots." A plurality of cutting elements 240 are mounted to each of the blades 220. The bit body 210 further includes a generally cylindrical internal fluid plenum and fluid passageways that extend through the bit body 210 to an exterior surface 250 of the bit body 210. Nozzles 260 may be secured within the fluid passageways proximate to the exterior surface 250 of the bit body 210 for controlling the hydraulics of the drill bit 200 during drilling.

During a drilling operation, the drill bit 200 may be coupled to a drill string (not shown). As the drill bit 200 is rotated within the wellbore, drilling fluid may be pumped down the drill string, through the internal fluid plenum and fluid passageways within the bit body 210 of the drill bit 200, and out from the drill bit 200 through the nozzles 260. Formation cuttings generated by the cutting elements 240 of the drill bit 200 may be carried with the drilling fluid through the fluid courses 230, around the drill bit 200, and back up the wellbore to an annular space within the wellbore and outside the drill string.

As shown in FIG. 6, sections of coating 280, which are represented in FIG. 6 by the cross-hatched areas for purposes of illustration, may be disposed over at least a portion of the exterior surfaces 250 of the bit body 210. The segments of coating 280 may be formed in accordance with the first, second, third, and/or fourth embodiments of the method for forming a coating, as discussed above in reference to FIGS. 1A through 1F, 2A through 2F, 3A through 3F, and 4A through 4F, respectively. The material comprising the coating 280 may be a hydrophobic material. The hydrophobic material may be, without limitation, any material or surface with which water droplets have a contact angle in air of at least 90°, as measured by a contact angle goniometer as described in the ASTM Standard D7334-08 (Standard Practice for Surface Wettability of Coatings, Substrates and Pigments by Advancing Contact Angle Measurement, ASTM Int'l, West Conshohocken, Pa., 2008), which standard is incorporated herein in its entirety by this reference. Hydrophobic materials include, for example and without limitation, non-polar silicones and fluorocarbons.

The hydrophobic coating 280 may be provided at, for example, regions of the drill bit 200 susceptible to balling or over which fluid flows, such as at pinch points (e.g., locations at which plates converge), cutting trajectory points (e.g., locations at which cuttings converge), the bit shank (i.e., where the bit head and threaded pin meet), surfaces of cutting elements 240, and/or surfaces of nozzles 260. For example, the hydrophobic coating 280 may be disposed over one or more regions of the exterior surfaces 250 of the bit body 210 of the drill bit 200 within the fluid courses 230. Such regions may include, for example, rotationally leading surfaces 270A of the blades 220, rotationally trailing surfaces 270B of the blades 220, under the cutting elements 240 where chip flow occurs, and behind the cutting elements 240. In additional embodiments, the hydrophobic material of the coating 280 may form a generally continuous coating disposed over at least substantially all exterior surfaces of the bit body 210 of the drill bit 200.

Figure 7:
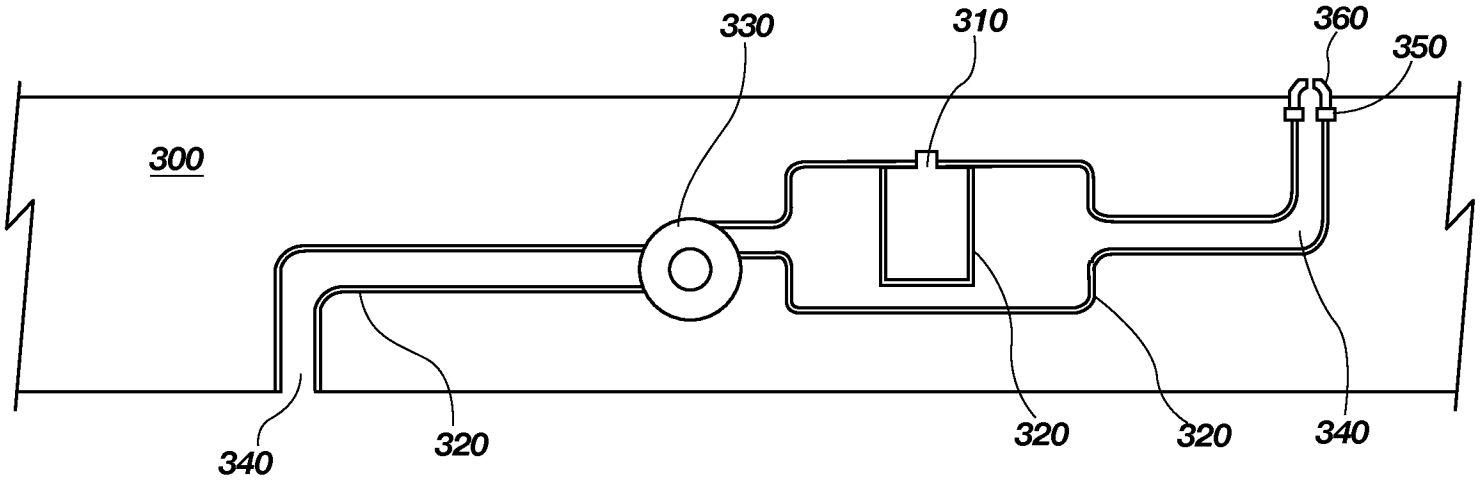
FIG. 7 is a simplified, schematically illustrated cross-sectional view of an embodiment of a wellbore tool that includes a sensor and flow line including coated surfaces formed in accordance with embodiments of methods as described herein.

FIG. 7 illustrates another wellbore tool of the present disclosure. Depicted is a wellbore tool segment 300 including a sensor. The sensor may include a sensor body 310. As a non-limiting example, the sensor may be an acoustic transceiver. The sensor body 310 may include, for example, a tuning fork. The sensor body 310 may include any structure known in the art for sensors. The sensor includes a hydrophobic coating 320 disposed over at least a portion of the sensor body 310. The hydrophobic coating 320 may be formed in accordance with the first, second, third, and/or fourth embodiment of the method for forming a coating, as discussed above in reference to FIGS. 1A through 1F, 2A through 2F, 3A through 3F, and 4A through 4F, respectively. The hydrophobic coating 320 may substantially cover the sensor body 310. The sensor may include, for example, sensors for detecting gas concentrations, viscosities, densities, etc. The sensor may include electrical, mechanical, optical, or other connectors (not shown) for communicating with components of the drill string or control system. For example, the sensor may communicate to a pump 330 through which drilling mud is pumped downhole. The pump 330 may adjust its output based on a signal from the sensor, such as to maintain constant fluid flow through a nozzle 360.

In some embodiments, a wellbore tool segment 300 may include a flow line 340 (e.g., a tube or pipe). The sensor may be in fluid communication with portions of a drill string (e.g., pump 330 and nozzle 360, which nozzle 360 may be a nozzle 260 of the drill bit 200 depicted in FIG. 6) via one or more flow lines 340. Flow lines 340 may include one or more surfaces coated with a hydrophobic coating 320, which coatings 320 may be formed in accordance with the first, second, third, and/or fourth embodiments of the method for forming a coating, as discussed above in reference to FIGS. 1A through 1F, 2A through 2F, 3A through 3F, and 4A through 4F, respectively.

In some embodiments, a body of a wellbore tool segment 300 may include a seal 350. For example, seals 350 may include elastomeric gaskets, O-rings, washers, etc. Such seals 350 may be disposed between portions of the wellbore tool segment 300, such as between a nozzle 360 and a flow line 340. Seals 350 may have surfaces including a hydrophobic coating 320 formed in accordance with the first, second, third, and/or fourth embodiment of the method for forming a coating, as discussed above in reference to FIGS. 1A through 1F, 2A through 2F, 3A through 3F, and 4A through 4F, respectively.

Figure 8:
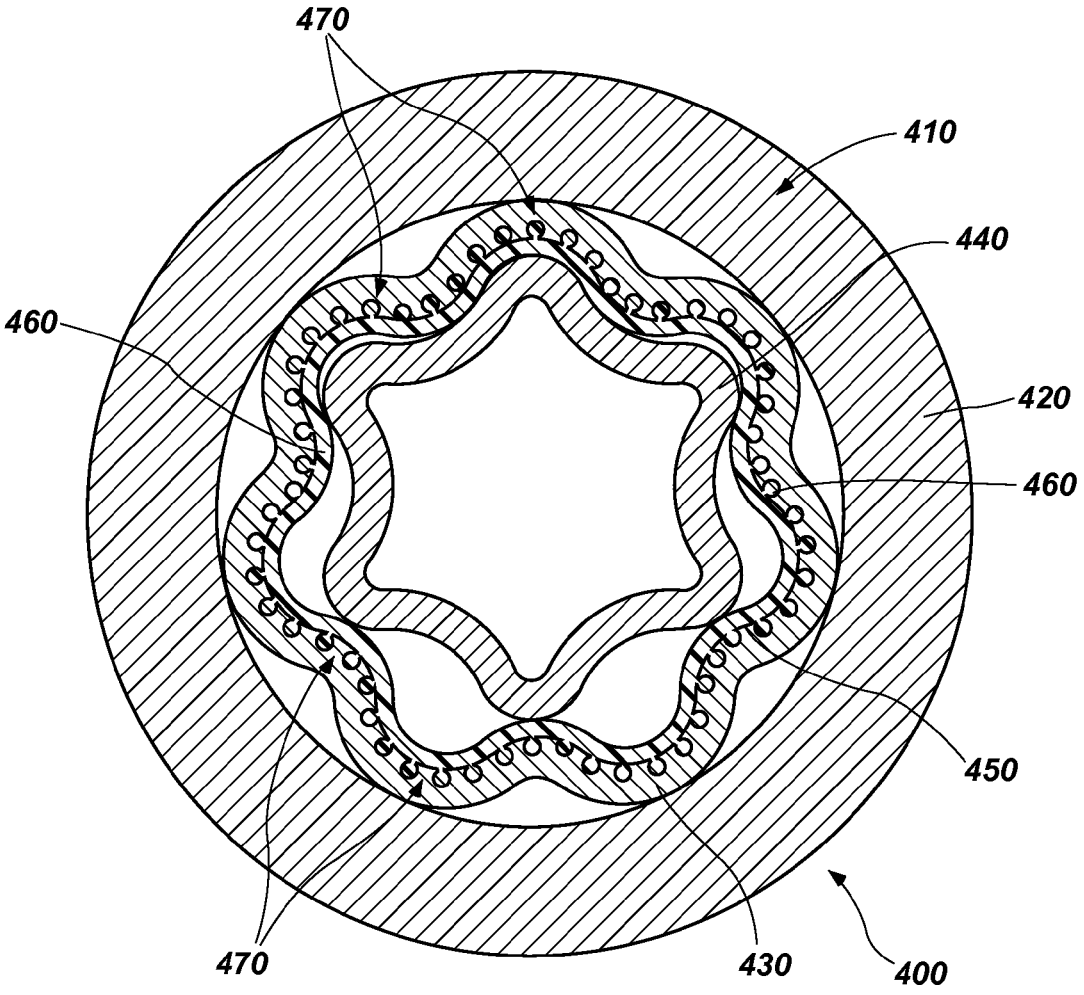
FIG. 8 is a simplified and schematically illustrated cross-sectional view of an embodiment of a component of a wellbore tool comprising a downhole motor that includes a stator having a coating formed in accordance with embodiments of methods as described herein.

FIG. 8 illustrates another wellbore tool of the present disclosure. Depicted is a lateral cross-section of a drive section 410 of a downhole drilling motor 400. The drive section 410 may be the power section 100 depicted in FIG. 5 or similar thereto. The motor 400 is a multi-lobed assembly used to drive drilling tools, such as a drill bit and the like, by pumping drilling fluid through the drive section 410 of the motor 400. As is typical of such motors 400, a stator/rotor drive converts the fluid energy of the drilling fluid in a rotational and precessional motion to turn an operatively-connected drill bit downhole.

The drive section 410 of the motor 400 includes an outer case 420 within which is disposed a rigid stator former 430. The stator former 430 has a helical, multi-lobed configuration. The stator former 430 may be formed of a rigid material, such as metal. A multi-lobed helical rotor 440 (e.g., a rotor like rotor 120 of FIG. 5) is disposed within the stator former 430 for rotation therein as drilling fluid is pumped through the stator former 430 to drive a drill bit.

An inner surface 450 of the stator former 430 has defined therein a pattern 470 of features. The pattern 470 of features may be a pattern of cavities, of trenches, of pillars, of ridges, or the like. A coating 460 is provided over the pattern 470 of features. The coating 460 may comprise an elastomeric material configured to sealingly engage portions of the rotor 440 as it rotates within the stator former 430. The coating 460 and pattern 470 may be formed in accordance with the first, second, third, and/or fourth embodiment of the method for forming a coating, as discussed above in reference to FIGS. 1A through 1F, 2A through 2F, 3A through 3F, and 4A through 4F, respectively.

Figure 9A:
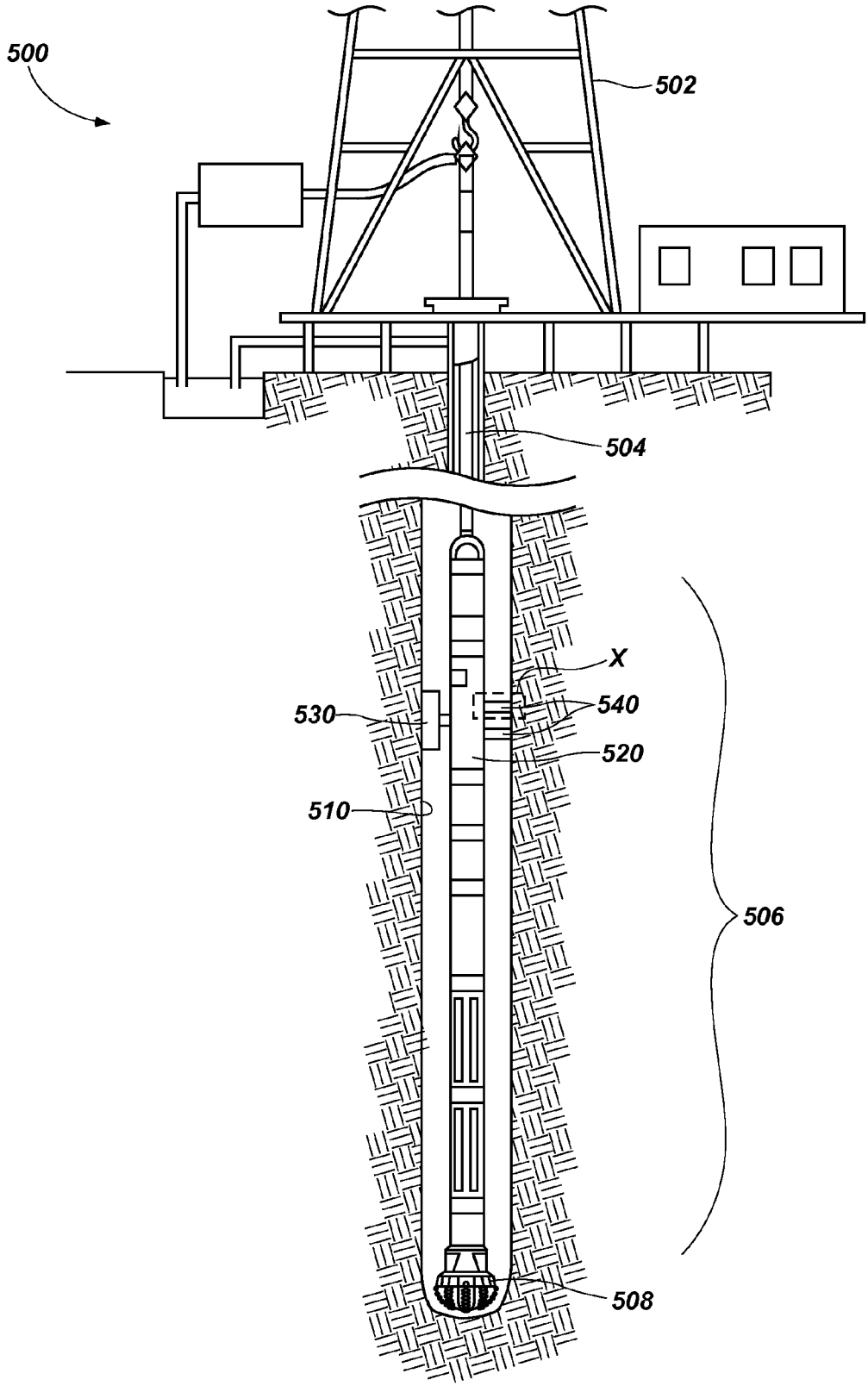
FIG. 9A is a simplified and schematically illustrated view of an embodiment of a drilling system including a formation sampling wellbore tool that includes a coating formed in accordance with embodiments of the methods as described herein.
Figure 9B:
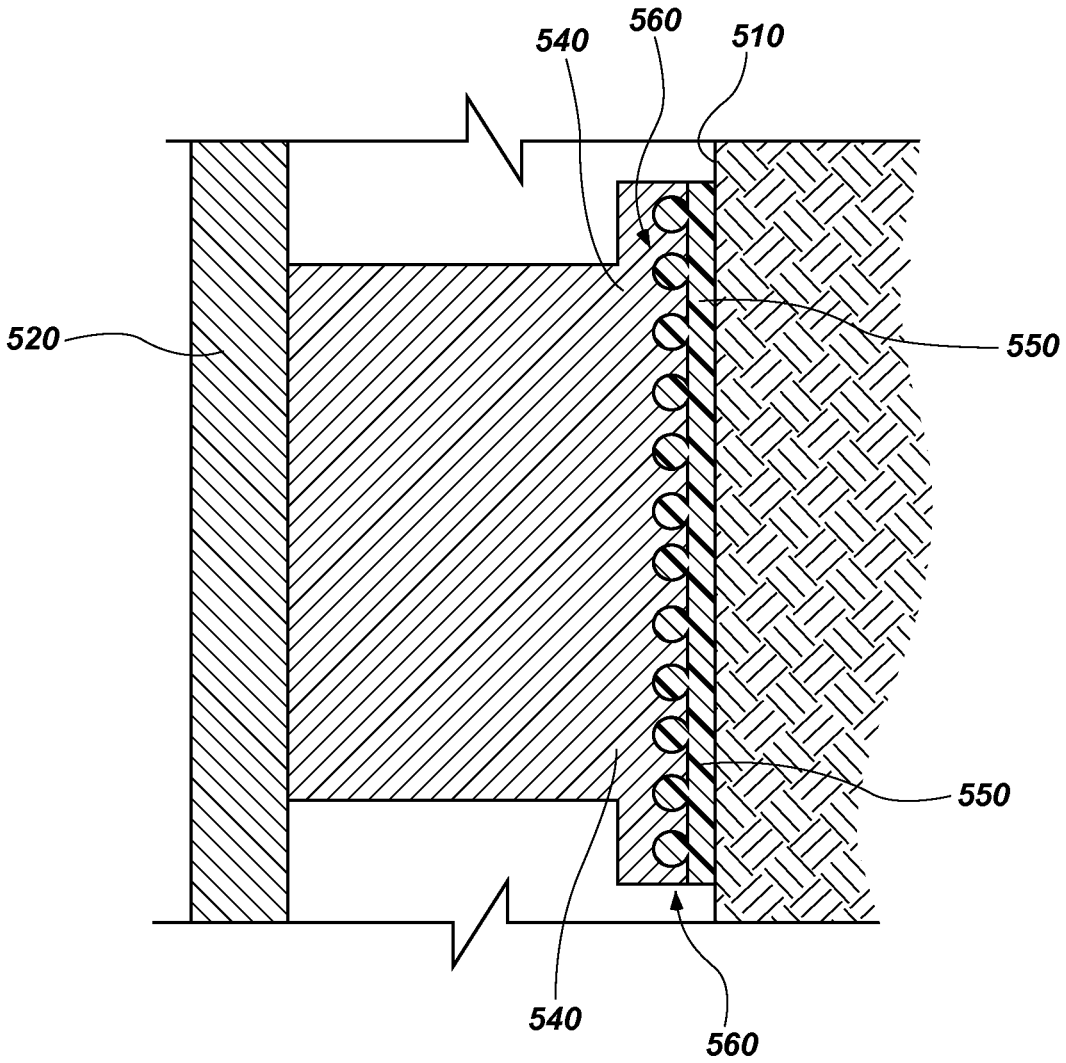
FIG. 9B is an insert view of a portion of the wellbore tool of FIG. 9A.

FIGS. 9A and 9B illustrate another wellbore tool of the present disclosure. Depicted is a drilling system including a formation sampling tool having one or more coated bore wall engagement feet. The drilling system 500 may be configured within a measurement—while drilling (MWD) or logging-while-drilling (LWD) system. A derrick 502 supports a drill string 504, which may be a coiled tube or drill pipe. The drill string 504 may support a bottom hole assembly (BHA) 506 with a drill bit 508 at a distal end of the drill string 504 for drilling a borehole 510 through earth formations. The drilling system 500 further includes a formation sampling tool 520 within the bottom hole assembly 506. The formation sampling tool 520 includes an extendable probe 530 having a bore wall engagement foot 540 at a distal end thereof. The extendable probe 530 may be hydraulically and/or electro-mechanically extendable to cause bore wall engagement foot 540 to firmly engage the borehole 510 wall. The formation sampling tool 520 may be configured for extracting a formation core sample, a formation fluid sample, or formation images, or may comprise a logging or other measuring tool configured to acquire nuclear information, electromagnetic information, and/or wellbore information, such as pressure, temperature, location, movement, and other information.

With reference to FIG. 9B, which is an insert view of dotted rectangle X of FIG. 9A, the bore wall engagement foot 540 of the formation sampling tool 520 may be provided with a coating 550 covering a pattern 560 of features. The pattern 560 of features may be a pattern of cavities, of trenches, of pillars, of ridges, or the like. The coating 550 may comprise an elastomeric material configured to pad the bore wall engagement foot 540 when contacting the borehole 510 wall and provide a fluid-tight seal. The coating 550 and pattern 560 may be formed in accordance with the first, second, third, and/or fourth embodiment of the method for forming a coating, as discussed above in reference to FIGS. 1A through 1F, 2A through 2F, 3A through 3F, and 4A through 4F, respectively.

A method of utilizing a wellbore tool, such as the power section 100 of FIG. 5; the drill bit 200 of FIG. 6; the wellbore tool segment 300 of FIG. 7; the motor 400, drive section 410, or stator former 430 of FIG. 8; or the formation sampling tool 520 of FIGS. 9A and 9B, in a subterranean formation includes forming the aforementioned wellbore tool. Forming the wellbore tool includes forming a body 10 having an exterior surface 12 and an interior region 13. The body 10 may be any or all of the power section body 110, bit body 210, and sensor body 310. Forming such body 10, power section body 110, bit body 210, and/or sensor body 310 includes forming a pattern 14 of features supported by the body 10, power section body 110, bit body 210, and/or sensor body 310. Forming the pattern 14 includes forming a first feature and forming a second feature spaced from the first feature by a first width at a first elevation and by a second width at a second elevation, the second width being different than the first width and the first elevation being further from the interior region 13 than the second elevation. Forming a wellbore tool further includes forming a coat, such as coating 34, coating 150, coating 280, or coating 320, over the pattern 14 of features. The method of utilizing the wellbore tool in a subterranean formation further includes disposing the wellbore tool in a borehole.

Additional non-limiting example embodiments of the disclosure are described below.

Embodiment 1

A method for forming a coating upon a wellbore tool, comprising forming a body comprising an outer surface and an interior region; forming a pattern of features supported by the body, comprising: forming a first feature; and forming a second feature spaced from the first feature by a first width at a first elevation and by a second width at a second elevation, the second width being different than the first width, the first elevation being further from the interior region than the second elevation; and forming a coating over the pattern of features.

Embodiment 2

The method of Embodiment 1, wherein forming the first feature comprises forming a first cavity; and forming the second feature spaced from the first feature comprises forming a second cavity spaced from the first cavity.

Embodiment 3

The method of Embodiment 2, wherein forming the first cavity and forming the second cavity comprise selectively exposing the outer surface of the body to laser irradiation to remove material therefrom.

Embodiment 4

The method of Embodiment 2, wherein forming the first cavity and forming the second cavity comprise selectively exposing the outer surface of the body to a chemical etchant to remove material therefrom.

Embodiment 5

The method of Embodiment 2, wherein forming the first cavity and forming the second cavity comprise selectively exposing the outer surface of the body to a mechanical, material-removing process.

Embodiment 6

The method of Embodiment 5, wherein selectively exposing the outer surface of the body to the mechanical, material-removing process comprises selectively exposing the outer surface of the body to a powder blasting particle jet to remove material therefrom.

Embodiment 7

The method of Embodiment 1, wherein forming the first feature comprises forming a first trench; and forming the second feature spaced from the first feature comprises forming a second trench spaced from the first trench by the first width at the first elevation and by the second width at the second elevation, the second width being less than the first width, the first elevation being further from the interior region than the second elevation.

Embodiment 8

The method of Embodiment 1, wherein forming a first feature comprises forming a first extension; and forming a second feature spaced from the first feature comprises forming a second extension spaced from the first extension.

Embodiment 9

The method of Embodiment 8, wherein forming the first extension comprises forming a first pillar comprising a head and a stem; and forming the second extension spaced from the first extension comprises forming a second pillar spaced from the first pillar by the first width at the first elevation and by the second width at the second elevation, the second width being greater than the first width, the first elevation being further from the interior region than the second elevation, and the head of the first pillar being at the first elevation.

Embodiment 10

The method of Embodiment 8, wherein forming the first extension comprises forming a first ridge; and forming the second extension comprises forming a second ridge spaced from the first ridge by the first width at the first elevation and by the second width at the second elevation, the second width being greater than the first width, the first elevation being further from the interior region than the second elevation.

Embodiment 11

The method of any of Embodiments 1 through 10, wherein forming the coat over the pattern of features comprises conformally forming a polymer on the pattern of features.

Embodiment 12

The method of any of Embodiments 1 through 11, further comprising, after forming the coating over the pattern of features, modifying the topology of an exterior surface of the coating.

Embodiment 13

A wellbore tool, comprising a body comprising an outer surface and an interior region; a pattern of features defined in at least a portion of the outer surface of the body, the pattern comprising a first feature; and a second feature spaced from the first feature by a first width at a first elevation and by a second width at a second elevation, the second width being different than the first width, the first elevation being further from the interior region than the second elevation; and a coating covering the pattern of features.

Embodiment 14

The wellbore tool of Embodiment 13, wherein the first feature comprises a first cavity; the second feature comprises a second cavity spaced from the first cavity by the first width at the first elevation and by the second width at the second elevation, the second width being less than the first width, the first elevation being further from the interior region than the second elevation; and the outer surface of the body defines the first elevation.

Embodiment 15

The wellbore tool of Embodiment 13, wherein the first feature comprises a first trench; the second feature comprises a second trench spaced from the first trench by the first width at the first elevation and by the second width at the second elevation, the second width being less than the first width, the first elevation being further from the interior region than the second elevation; and the outer surface of the body defines the first elevation.

Embodiment 16

The wellbore tool of Embodiment 13, wherein the first feature comprises a first extension; the second feature comprises a second extension spaced from the first extension by the first width at the first elevation and by the second width at the second elevation, the second width being greater than the first width, the first elevation being further from the interior region than the second elevation; and the outer surface of the body defines the second elevation.

Embodiment 17

The wellbore tool of Embodiment 16, wherein the first extension comprises a first ridge; the second extension comprises a second ridge spaced from the first ridge by the first width at the first elevation and by the second width at the second elevation, the second width being greater than the first width, the first elevation being further from the interior region than the second elevation; and the outer surface of the body defines the second elevation.

Embodiment 18

The wellbore tool of any of Embodiments 13 through 17, wherein the coating covering the pattern of features comprises a coating surface, the coating surface being smooth.

Embodiment 19

The wellbore tool of any of Embodiments 13 through 18, wherein the body comprises at least one bore wall engagement foot operatively connected to a formation sampling tool, the bore wall engagement foot comprising the outer surface and the interior region; and the pattern of features is defined in at least a portion of the outer surface of the bore wall engagement foot.

Embodiment 20

The wellbore tool of any of Embodiments 13 through 18, wherein the body comprises a drill bit comprising the outer surface and the interior region; and the pattern of features is defined in at least a portion of the outer surface of the drill bit.

Embodiment 21

A method of utilizing a wellbore tool in a subterranean formation, the method comprising forming a wellbore tool comprising forming a body comprising an outer surface and an interior region; forming a pattern of features supported by the body, comprising forming a first feature; and forming a second feature spaced from the first feature by a first width at a first elevation and by a second width at a second elevation, the second width being different than the first width, the first elevation being further from the interior region than the second elevation; and forming a coating over the pattern of features; and disposing the wellbore tool in a borehole.

Embodiment 22

The method of Embodiment 21, wherein forming the body comprises forming a drill bit.

Embodiment 23

The method of any of Embodiments 21 and 22, wherein the wellbore tool is a downhole motor and forming the body comprises forming a power section of the downhole motor.

Although the foregoing description contains many specifics, these are not to be construed as limiting the scope of the present methods and devices, but merely as providing certain embodiments. Similarly, other embodiments of the methods and devices may be devised that do not depart from the scope of the present disclosure. For example, features described herein with reference to one embodiment also may be provided in others of the embodiments described herein. The scope of the invention is, therefore, indicated and limited only by the appended claims and their legal equivalents, rather than by the foregoing description. All additions, deletions, and modifications to the methods and devices, as disclosed herein, which fall within the meaning and scope of the claims, are encompassed by the present invention.

What is claimed is:

1. A method for forming a coating upon a wellbore tool, comprising:

forming a body of a wellbore tool, the body comprising an outer surface and an interior region;

forming a pattern of features supported by the body, comprising:

forming a first feature; and forming a second feature spaced from the first feature by a first width at a first elevation and by a second width at a second elevation, the second width being different than the first width, the first elevation being further from the interior region than the second elevation; and forming a coating over the pattern of features, comprising forming at least one segment of coating material to fill a volume defined by sidewalk of the pattern of features and to mechanically interlock the coating with the pattern of features, the at least one segment having a wider width between the sidewalks at the second elevation than a width of the at least one segment of coating material between the sidewalk at the first elevation, the width of the at least one segment of coating material between the sidewalls at the first elevation being 100 micrometers or less, forming the at least one segment of coating material comprising applying the coating material over the pattern of features by at least one of evaporation, sputtering, chemical vapor deposition, electroplating, spin coating, spray coating, blanket coating, and dip coating.

2. The method of claim 1, wherein forming the first feature comprises forming a first cavity providing the volume defined by the sidewalk of the pattern of features; and forming the second feature spaced from the first feature comprises forming a second cavity spaced from the first cavity, the second cavity providing another volume defined by other sidewalls of the pattern of features.

3. The method of claim 2, wherein forming the first cavity and forming the second cavity comprise selectively exposing the outer surface of the body to laser irradiation to remove material therefrom.

4. The method of claim 2, wherein forming the first cavity and forming the second cavity comprise selectively exposing the outer surface of the body to a chemical etchant to remove material therefrom.

5. The method of claim 2, wherein forming the first cavity and forming the second cavity comprise selectively exposing the outer surface of the body to a mechanical, material-removing process to remove material therefrom.

6. The method of claim 1, wherein forming the first feature comprises forming a first trench, the first trench providing the volume defined by the sidewalk of the pattern of features; and forming the second feature spaced from the first feature comprises forming a second trench spaced from the first trench by the first width at the first elevation and by the second width at the second elevation, the second width being less than the first width, the first elevation being further from the interior region than the second elevation, the second trench providing another volume defined by other sidewalk of the pattern of features.

7. The method of claim 1, wherein forming a first feature comprises forming a first extension having a sidewall; and forming a second feature spaced from the first feature comprises forming a second extension spaced from the first extension, the second extension having another sidewall; and the volume is defined, at east in part, by the sidewall of the first extension and the another sidewall of the second extension.

8. The method of claim 7, wherein forming the first extension comprises forming a first pillar comprising a head and a stem, the stem having the sidewall; and forming the second extension spaced from the first extension comprises forming a second pillar spaced from the first pillar by the first width at the first elevation and by the second width at the second elevation, the second width being greater than the first width, the first elevation being further from the interior region than the second elevation, and the head of the first pillar being at the first elevation, the second pillar comprising another head and another stem, the another stem having the another sidewall; and the volume is defined, at least in part, by the sidewall of the stem of the first extension and the another sidewall of the another stem of the second pillar.

9. The method of claim 7, wherein forming the first extension comprises forming a first ridge having the sidewall; and forming the second extension comprises forming a second ridge spaced from the first ridge by the first width at the first elevation and by the second width at the second elevation, the second width being greater than the first width, the first elevation being further from the interior region than the second elevation, the second ridge having the another sidewall; and the volume is defined, at least in part, by the sidewall of the first ridge and the another sidewall of the second ridge.

10. The method of claim 1, further comprising, after forming the coating over the pattern of features, modifying the topology of an exterior surface of the coating.

11. A wellbore tool, comprising:

a wellbore tool body having a thickness from an outer surface through an interior region of the wellbore tool body;

a pattern of features defined in at least a portion of the outer surface of the wellbore tool body, the features having at least one dimension of 1 micron or less, the pattern comprising:

a first feature; and a second feature spaced from the first feature by a first width at a first elevation and by a second width at a second elevation, the second width being different than the first width, the first elevation being further from the interior region than the second elevation; and a coating covering and mechanically interlocked with the pattern of features, the coating comprising segments each filling a volume defined by sidewalls of the pattern of features, the segments having wider widths between the sidewalls at the second elevation than widths between the sidewalls at the first elevation, the widths between the sidewalls at the first elevation being 100 micrometers or less, the segments not extending through the thickness of the wellbore tool body.

12. The wellbore tool of claim 11, wherein the first feature comprises a first cavity providing the volume defined by the sidewalk of the pattern of features;

the second feature comprises a second cavity spaced from the first cavity by the first width at the first elevation and by the second width at the second elevation, the second width being less than the first width, the first elevation being further from the interior region than the second elevation, the second cavity providing another volume defined by other sidewalk of the pattern of features; and the outer surface of the wellbore tool body defines the first elevation.

13. The wellbore tool of claim 11, wherein the first feature comprises a first trench providing the volume defined by the sidewalk of the pattern of features;

the second feature comprises a second trench spaced from the first trench by the first width at the first elevation and by the second width at the second elevation, the second width being less than the first width, the first elevation being further from the interior region than the second elevation, the second trench providing another volume defined by other sidewalk of the pattern of features; and the outer surface of the wellbore body defines the first elevation.

14. The wellbore tool of claim 11, wherein the first feature comprises a first extension having a sidewall;

the second feature comprises a second extension spaced from the first extension by the first width at the first elevation and by the second width at the second elevation, the second width being greater than the first width, the first elevation being further from the interior region than the second elevation, the second extension having another sidewall;

the volume is defined, at least in part, by the sidewall of the first extension and the another sidewall of the second extension; and the outer surface of the wellbore tool body defines the second elevation.

15. The wellbore tool of claim 14, wherein the first extension comprises a first ridge having the sidewall;

the second extension comprises a second ridge spaced from the first ridge by the first width at the first elevation and by the second width at the second elevation, the second width being greater than the first width, the first elevation being further from the interior region than the second elevation, the second ridge having the another sidewall;

the volume is defined, at least in part, by the sidewall of the first ridge and the another sidewall of the second ridge; and the outer surface of the wellbore tool body defines the second elevation.

16. The wellbore tool of claim 11, wherein the wellbore tool body comprises at least one bore wall engagement foot operatively connected to a formation sampling tool, the bore wall engagement foot comprising the outer surface and the interior region; and the pattern of features is defined in at least a portion of the outer surface of the bore wall engagement foot.

17. The wellbore tool of claim 11, wherein the wellbore tool body comprises a drill bit comprising the outer surface and the interior region; and the pattern of features is defined in at least a portion of the outer surface of the drill bit.

18. A method of utilizing a wellbore tool in a subterranean formation, the method comprising:

forming a wellbore tool comprising:

forming a body of the wellbore tool, the body comprising an outer surface and an interior region;

forming a pattern of features supported by the body, comprising:

forming a first feature; and forming a second feature spaced from the first feature by a first width at a first elevation and by a second width at a second elevation, the second width being different than the first width, the first elevation being further from the interior region than the second elevation; and forming a coating over the pattern of features, at least one portion of the coating having a width of 100 micrometers or less, at the first elevation, the width at the first elevation being less than a width at the second elevation, the body extending laterally over a portion of the at least one portion of the coating to mechanically interlock the at least one portion of the coating with the body, forming the coating comprising applying a coating material over the pattern of features by at least one of evaporation, sputtering, chemical vapor deposition, electroplating, spin coating, spray coating, blanket coating, and dip coating; and disposing the wellbore tool in a borehole.

19. The method of claim 18, wherein forming the body of the wellbore tool comprises forming a drill bit.

20. The method of claim 18, wherein the wellbore tool is a downhole motor and forming the body of the wellbore tool comprises forming a power section of the downhole motor.

* * * * *